US008091907B1

(12) United States Patent
Barnett

(10) Patent No.: US 8,091,907 B1
(45) Date of Patent: Jan. 10, 2012

(54) PORTABLE WHEEL STEP

(76) Inventor: John R. Barnett, Oklahoma City, OK (US)

( * ) Notice: Subject to any disclaimer, the term of this patent is extended or adjusted under 35 U.S.C. 154(b) by 179 days.

(21) Appl. No.: 12/640,006

(22) Filed: Dec. 17, 2009

(51) Int. Cl.
*E06C 5/00* (2006.01)

(52) U.S. Cl. ..... 280/165; 182/150

(58) Field of Classification Search ..... 280/163, 280/165; 182/90, 92, 127, 150
See application file for complete search history.

(56) References Cited

U.S. PATENT DOCUMENTS

| | | | | |
|---|---|---|---|---|
| 2,378,678 | A | 6/1945 | Anderson | |
| 2,848,150 | A | 1/1955 | Tans | |
| 4,782,916 | A | 11/1988 | Hayes | |
| 4,800,987 | A * | 1/1989 | Liles | 182/92 |
| 4,947,961 | A | 8/1990 | Dudley | |
| 5,133,429 | A | 7/1992 | Densley | |
| 5,456,479 | A | 10/1995 | Conger | |
| 6,457,558 | B1 | 10/2002 | Ehnes | |
| 6,499,564 | B2 | 12/2002 | Puglisi | |
| 6,550,578 | B1 | 4/2003 | Law et al. | |
| 6,767,023 | B1 | 7/2004 | Nicholson | |
| 6,957,719 | B2 | 10/2005 | Ehnes | |
| 7,059,449 | B2 | 6/2006 | Zhang | |
| 7,168,523 | B1 | 1/2007 | Tafoya et al. | |
| D573,929 | S | 7/2008 | Black | |
| 7,455,307 | B2 | 11/2008 | Seeley et al. | |
| 2006/0157301 | A1 * | 7/2006 | Embretsen | 182/150 |
| 2006/0226624 | A1 * | 10/2006 | Chen | 280/165 |

* cited by examiner

*Primary Examiner* — John Walters

(57) ABSTRACT

The Portable Wheel Step is a device that can be temporarily affixed to a pickup truck's tire and wheel to aid individuals in easily accessing items in the bed of the truck or under the hood. This unique product can give users extra height so they can reach certain areas of the truck in a safe, secure manner with less effort. By stepping onto the device, it may move into a slight downward position, locking into place, creating a step. With the apparatus being in a configuration that is one solid piece, there is no assembly required. With the apparatus having a flat compact stature, the product can easily be stored behind the seat area of a pickup truck.

1 Claim, 2 Drawing Sheets

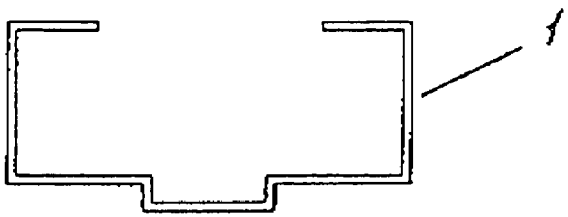
FIG #1
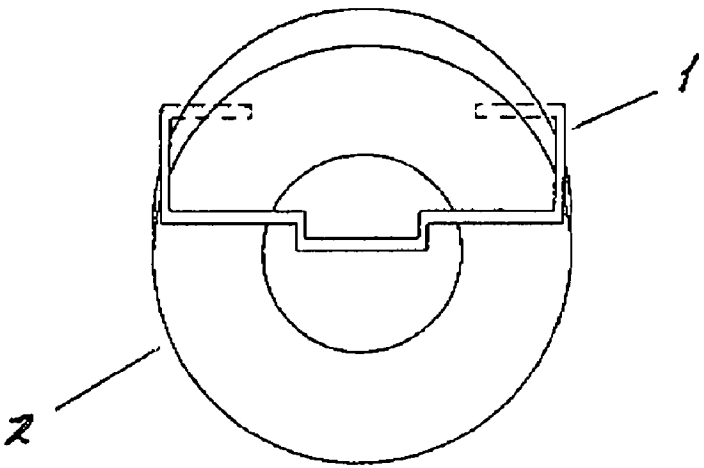
FIG #2

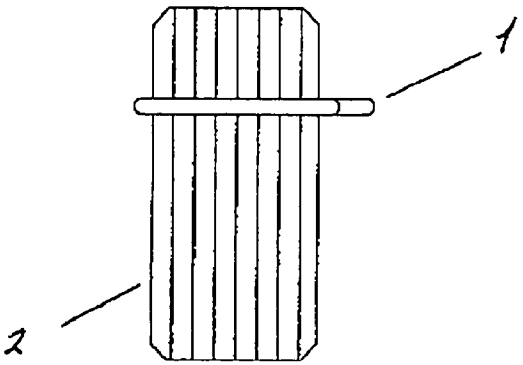
FIG #3
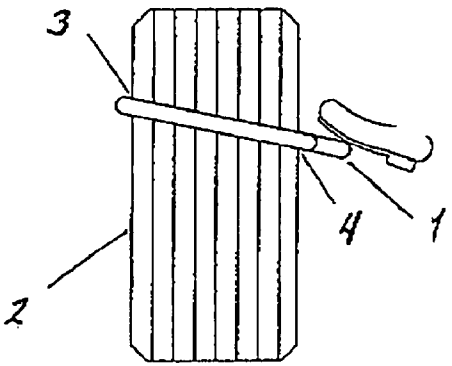
FIG #4

PORTABLE WHEEL STEP

CROSS REFERENCE TO RELATED PATENTS

References Cited

U.S. Patent Documents

| | | | |
|---|---|---|---|
| 2,378,678 | Jun. 19,1945 | Anderson, W. R. | 182/150 |
| 2,848,150 | Aug. 19, 1958 | Tans, L. F. | 182/150 |
| 4,782,916 | Nov. 8, 1988 | Hays, Kenneth E. | 182/150 |
| 4,947,961 | Aug. 14, 1990 | Dudley, Frank | 182/92 |
| 5,133,429 | Jul. 28, 1992 | Densley, Joseph S. | 182/150 |
| 5,456,479 | Oct. 10, 1995 | Conger, Ronald S. | 280/165 |
| 6,457,558 | Oct. 1, 2002 | Ehnes, Steve L. | 182/150 |
| 6,499,564 | Dec. 31, 2002 | Puglisi, Kenneth Lee | 182/150 |
| 6,550,578 | Apr. 22, 2003 | Law, et al. | 182/150 |
| 6,767,023 | Jul 27, 2004 | Nicholson, Richard L. | 280/165 |
| 6,957,719 | Oct. 25, 2005 | Ehnes, Steve L. | 182/150 |
| 7,059,449 | Jun. 13, 2006 | Zhang, Shouyun | 182/150 |
| 7,168,523 | Jan. 30, 2007 | Tafoya, et al. | 182/150 |
| D573929 | Jul. 29, 2008 | Black, Daniel L. | D12/203 |
| 7,455,307 | Nov. 25, 2008 | Seely, et al. | 280/163 |

FEDERALLY SPONSORED RESEARCH

Not applicable

DESCRIPTION

Background of Invention

Because of their large size, accessing items in the bed of a pickup truck can be an arduous task. An individual may have to actually get in the bed or employ the use of a ladder in order to reach objects in the back. Trying to gain entry under the hood of the vehicle may also prove to be difficult. Having a simple and easy way to be elevated to reach these areas may assist more individuals in completing their task in a timelier, safer, and more comfortable fashion.

DETAILED DESCRIPTION OF INVENTION

The Portable Wheel Step is an apparatus that can be affixed to a tire and wheel to provide users with a stepstool-like device. This product has the shape of an open-sided rectangle, large enough to go over and around a tire and wheel. The closed side of the rectangle contains a series of four 90-degree bends, creating an outward area of approximately two inches by ten inches in length. The unit may measure approximately thirty inches in length. To use this item, one would place the device over and around a tire and wheel until it rest on the tire, just above the largest outside diameter of the tire. Then by stepping onto the unit, it may move to a slight downward angle, locking in to place. This creates the step. This item may be produced from steel or a similar, durable material. Because of its flat and compact stature, this product may easily be stored behind the seat area of a pickup truck. This item may be produced in various sizes to accommodate different sizes and makes of vehicles' tires and wheels. The exact dimensions, materials used for construction and method of operation of the apparatus may vary upon manufacturing.

BRIEF DESCRIPTION OF DRAWINGS

3 Sheets

FIG. #1 illustrates the top view of the apparatus, 1, and the bends it contains. Note: all bends are at a 90-degree angle.

FIG. #2 illustrates the apparatus, 1, on the wheel, 2, just above the widest configuration of the wheel.

FIG. #3 illustrates the side view of the apparatus, 1, positioned on the wheel, 2, of the vehicle just above the widest configuration of the wheel.

FIG. #4 illustrates the side view and possible position of the apparatus, 1, on the wheel, 2, once weight is applied. Points 3 and 4 in the drawing denotes the pinch points that lock the apparatus, 1, in its place once weight is applied.

DESCRIPTION OF PREFERRED EMBODIMENT

FIG. 1 illustrates the configuration of the apparatus. This apparatus has the shape of an open-sided rectangle. The closed side of the rectangle contains a series of four 90-degree bends creating an outward area. This outward area is the step area of the apparatus. This item may be produced from steel or a similar, durable material.

FIG. 2 illustrates the apparatus as it has been placed over and around a tire and wheel, resting just above the largest outside diameter of the tire and wheel. The open-sided section of the rectangle is located on the back portion of the tire and wheel, this creates support for the apparatus without interfering with any of the wheel's attachments.

FIG. 3 illustrates a side view of the apparatus as it rest on the tire just above the largest outside diameter of the tire and wheel.

FIG. 4 illustrates the side view and possible position of the apparatus once weight is applied to the apparatus. This downward angle creates pinch points on the front and back of the tire, locking the apparatus in place.

I claim:

1. A portable wheel step comprising:

a support frame configured to be placed over a top of a wheel;

said support frame including two spaced apart, co-axial rear members, a right side member, a left side member, and a front portion;

said front portion including a right front member, a left front member and a step member, wherein said right front member and left front member are co-axial, said step member is outwardly laterally spaced from said right front member and said left front member and joined to said right front member and said left front member by two parallel connecting members; and wherein said two spaced apart, co-axial rear members, said right side member, said left side member, said right front member, said left front member, said step member and said parallel connecting members are configured in a common horizontal plane.

* * * * *